United States Patent [19]

Laurent

[11] 4,297,951

[45] Nov. 3, 1981

[54] DETACHABLE GRIP FOR COUPLING A CARRIAGE

[75] Inventor: Roger Laurent, Chambery, France

[73] Assignee: Pomagalski S.A., Fontaine, France

[21] Appl. No.: 34,027

[22] Filed: Apr. 27, 1979

[30] Foreign Application Priority Data

May 2, 1978 [FR] France ..... 78 13033

[51] Int. Cl.[3] ..... B61B 7/20

[52] U.S. Cl. ..... 104/209; 104/202; 104/211

[58] Field of Search ..... 104/202–209, 104/211

[56] References Cited

U.S. PATENT DOCUMENTS 1,436,911 11/1922 Roe et al. ..... 104/208
3,685,457 8/1972 Wallmannsberger ..... 104/209
3,785,296 1/1974 Berry et al. ..... 104/209

FOREIGN PATENT DOCUMENTS 421031 10/1910 France ..... 104/209
810279 3/1937 France ..... 104/209
1453517 9/1966 France ..... 104/209

*Primary Examiner*—Richard A. Bertsch
*Attorney, Agent, or Firm*—Stevens, Davis, Miller & Mosher

[57] ABSTRACT

The invention relates to a detachable grip of a monocable transport installation. The grip has a pair of jaws which is both pivotally mounted on a spindle and urged into a clamping position by means of a compression spring which acts on a piston connected by link-rods to the operating shanks of the jaws. In the clamping position the gauge of the grip is not increased.

4 Claims, 3 Drawing Figures

DETACHABLE GRIP FOR COUPLING A CARRIAGE

The invention relates to a detachable grip for coupling a carriage supporting a load on to the overhead cable of a monocable transport installation. A pair of jaws for clamping the cable are elastically stressed in their approached position, and a control mechanism moves the said jaws into a separated position for the opening of the grip.

A known grip of the type mentioned for coupling a carriage to the haulage cable of a bi-cable installation has jaws and a control mechanism symmetrical in relation to the cable. The dimensions of the grip and its mechanism are large, but in the case of these bi-cable installations this problem is secondary, and it is not difficult to house the control mechanism within the gauge required for passing over the guide sheaves. In a mono-cable installation the grip coupled on to the cable must be able to pass over cable support sheaves and under cable hold-down sheaves without causing excessive shocks and the whole of the mechanism must be on the same side of the grip. The opening of a single jaw facilitates the designing of such a grip for a monocable transporter, but has the disadvantage of necessitating a lateral displacement of the gondola to separate the fixed grip from the cable and allow the removal of the grip from the cable. On the coupling of a carriage on the cable the closing of the mobile jaw implies, in a manner analogous to that described above, a lateral displacement of the gondola which can cause oscillations.

The object of this invention is to provide a remedy for this disadvantage, and to permit the execution of a grip with symmetrical opening of the jaws, while respecting the gauge necessary for a mono-cable installation.

The detachable grip in accordance with the invention has jaws which are both mounted symmetrically so as to rotate on a spindle rigidly fixed to the body of the grip. Each jaw has an operating shank, the end of which works in conjunction with the said control mechanism so as to impart to the said jaws a symmetrical grip opening and/or closing rotation. The whole is so devised that in the position in which the grip is coupled on to the cable, the said spindle is parallel to and above the cable in the vertical plane of the latter and the said operating shanks of the jaws project laterally on the same side and in the same plane to respect the gauge for passing the cable support and hold-down sheaves. In the position in which the grip is closed, the operating shanks of the two jaws are side-by-side and their dimension in height corresponds exactly with that of a conventional grip. In the open position of the grip, the operating shanks are apart and no longer respect the gauge, but on the uncoupling the carriage runs on rails in the stations, and no longer passes over support sheaves or under hold-down sheaves.

The invention also has the object of simplifying the operating maneuver by actioning the grip by a single control lever which suppresses the clamping force of the jaws and moves the mobile jaws from the closed position to the open position and inversely.

The correct operation of a grip necessitates a correct positioning during the coupling maneuver, and according to a development of the invention, the operating force exerted on the control level is exerted downwards in the direction of the application of the carriage on the running rail. The carriage is advantageously equipped with two pairs of wheels able to take up the reaction of the operating force and to prevent any swinging of the carriage and any incorrect positioning of the grip at the moment of the coupling on the cable.

The carriage supporting the gondola is equipped advantageously with two coupling grips connected by a rigid cross-piece, each grip having an individual opening and closing lever.

Other advantages and characteristics will appear more clearly from the description to follow of a mode of application given as a non-restrictive example and shown in the attached drawings, in which.

Figure 1:
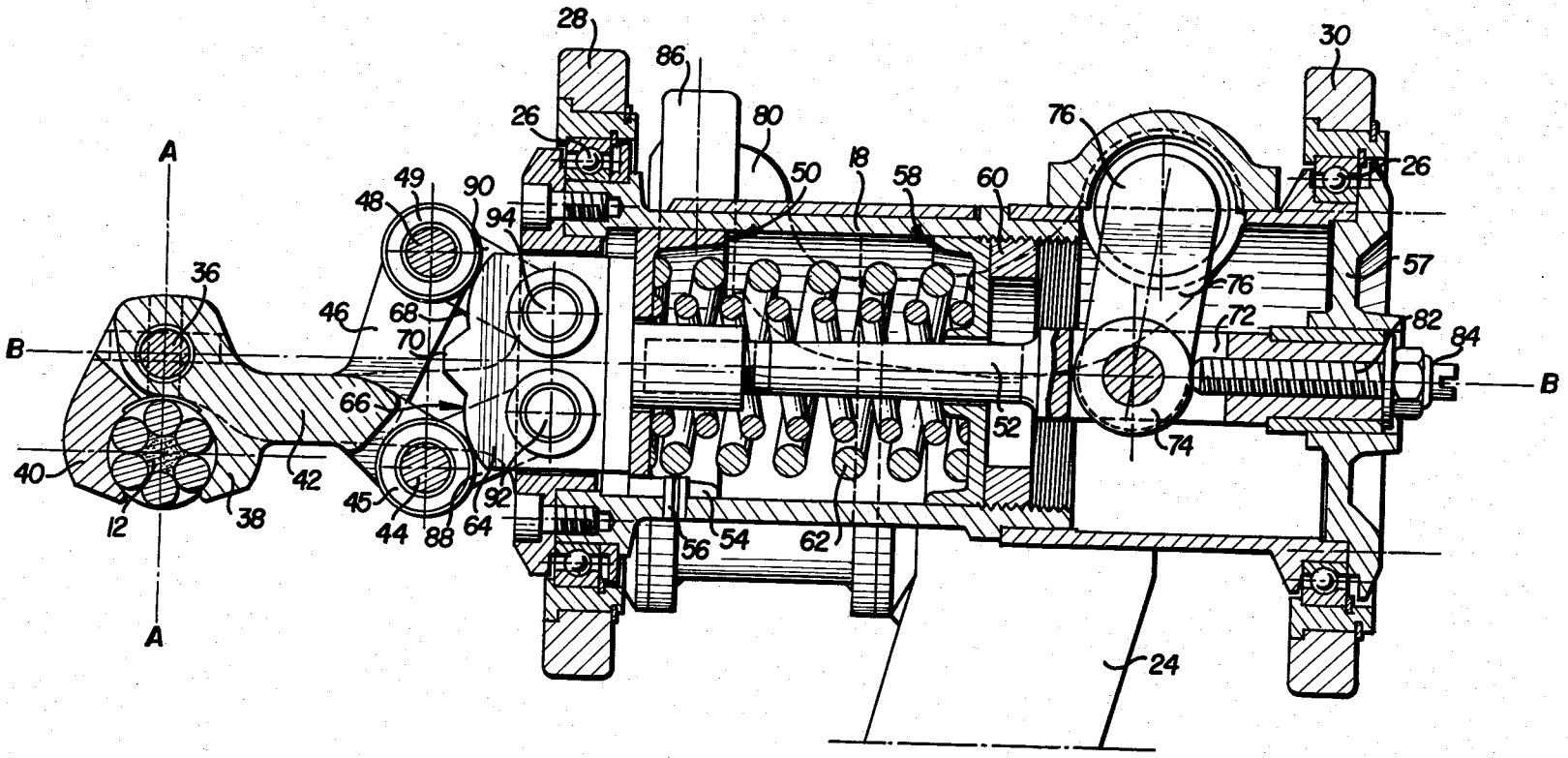
FIG. 1 is a longitudinal cross-section of a grip according to the invention.
Figure 2:
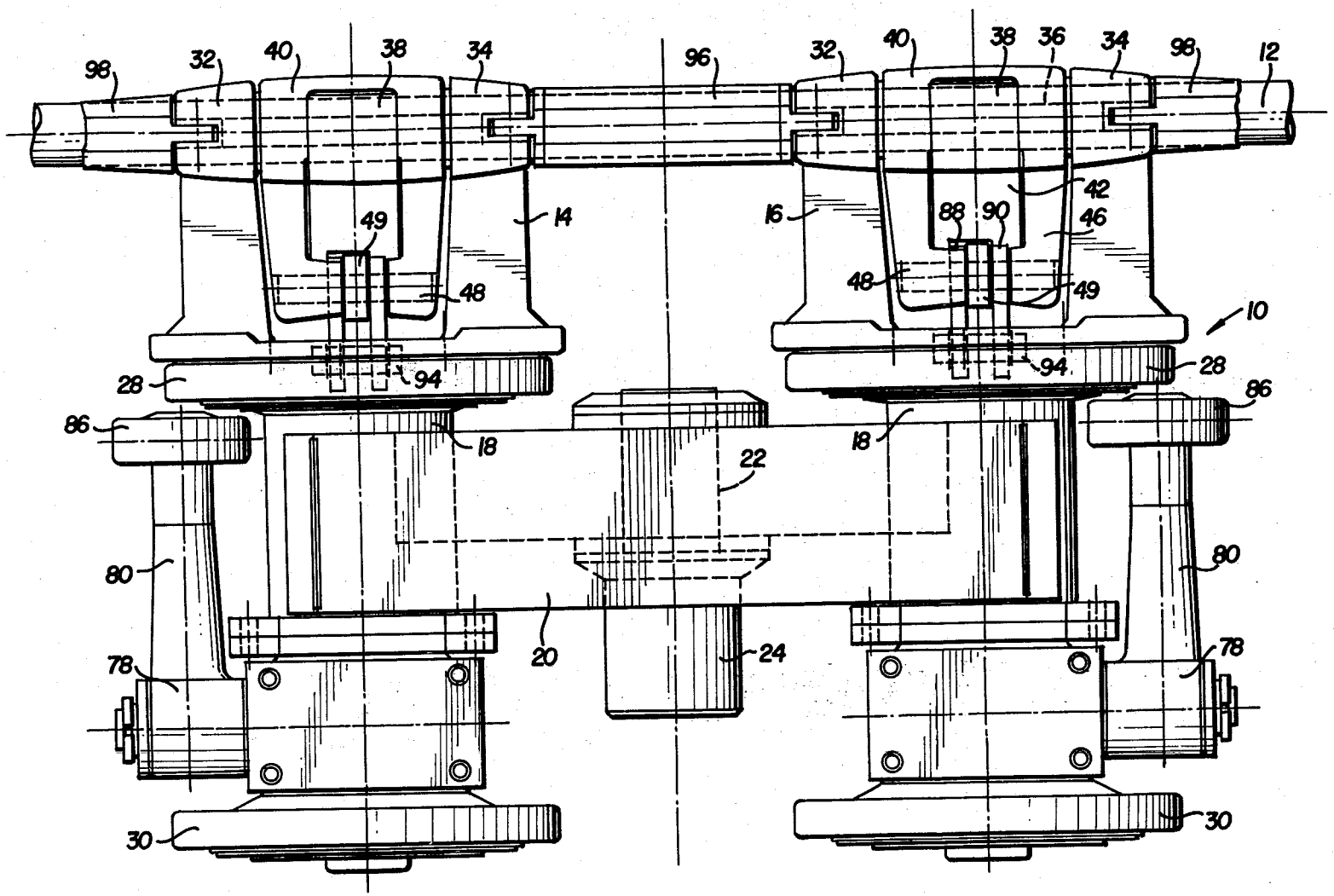
FIG. 2 is a view in elevation of a carriage equipped with two grips as per FIG. 1.

In these figures, a carriage 10 of an overhead cable transport installation, in particular a gondola lift, permits the coupling of a load, in this case a gondola, on a continuously moving overhead cable 12, and the uncoupling of the gondola from cable 12 in the stations, in a manner well known in itself. The carriage 10 has two identical coupling grips 14, 16, the bodies 18 of which are rigidly linked by a cross-piece 20, which has in its median part a spindle 22 on which is hinged the suspension 24 of the gondola (not shown). On each grip body 18 are mounted by means of ball-bearing 26, runner-wheels 28, 30, able to run on two spaced rails (not shown) in the stations. The two pairs of wheels 28, 30 position the carriage 10 and prevent any transversal swinging of the gondola.

The two grips 14, 16 are identical and only one of these is described in detail below, more particularly with reference to FIG. 1, the same reference numbers being used to designate the same components of the two grips in the other figures. The tube-shaped body 18 is extended by a pair of carrier jaws 32, 34 bearing, when the grip is in the coupled position, on the upper surface of the cable 12. Between the carrier jaws 32, 34 is a spindle 36 rigidly fixed to the jaws 32, 34 and on this spindle is hinged a pair of jaws 38, 40 for clamping the cable 12. In the position in which the grip is coupled on to the cable 12, the spindle 36 is in the vertical plan of the line A—A and above the cable 12, the jaws 38, 40 being symmetrical in relation to this vertical plane. The jaw 38 is inserted between the two branches of jaw 40 in a manner well-known in itself. The longitudinal axis B—B of the body of grip 18 is perpendicular to the vertical plane A—A and cuts the spindle 36.

The jaw 38 has an operating shank 42 with the end curved downwards, with a spindle 44 of a ball-bearing 45. In an analogous manner, the mobile jaw 40 has an operating shank 46 in the shape of a fork enframing the shank 42 and with the end curved upwards, carrying the spindle 48 of a ball-bearing 49. The bearings 45, 49 are arranged symmetrically in relation to the axis B—B of the body 18. In the clamping position of the jaws 38, 40, shown in the figures, the operating shanks 42, 46 lie in the profile of the arms of the carrier jaws 32, 34, without increasing the gauge of the grip. The hinge on spindle 36 does not increase the height dimension of the grip jaws.

The control mechanism of the jaws 38, 40 is housed inside the body 18 and has a piston 50 the piston rod 52 extending along the axis B—B and passing through the closing end plate 57 of the body 18. Piston rod 52 passes through an opening in an intermediate plate 58, retained by a nut 60, screwed into the body 18. A pair of compression springs 62 is inserted between the piston and the intermediate plate and exerts on the piston 50 a pressure in the direction of the jaws 38, 40.

The front end of the piston 50 has a cam 64 with a symmetrical profile 66, 68, working in conjunction with the bearings 45, 49. The profiles 66, 68 meet at an intermediate boss 70, the function of which will emerge more clearly later. It will be understood that the cam 64, applied against the bearings 45, 49 under the action of the springs 62, tends to separate the bearings 45, 49 and exerts on the jaws 38, 40 a moment of clamping on the cable 12. The whole being symmetrical in relation to the axis B—B, the clamping forces of the jaws 38, 40 are equal. The clamping force of the jaws 38, 40 can be regulated by the simple screwing or unscrewing of the nut 60, which by moving the intermediate plate 58 increases or decreases the initial compression of the springs 62.

The piston rod 52 has in its intermediate part, between the plates 57, 58, an opening or yoke 72, in which is inserted a wheel 74, carried on the end of a crank 76, mounted so as to rotate on the body 18, on a spindle 78. The other end of the spindle 78 carries a control arm or lever 80. An adjusting screw is screwed into a tapped bore in the end of piston rod 52, so as to come into contact at its end with wheel 74. The screw 82 with lock-nut 84 positions wheel 74 in the yoke 72, and thus the control lever 80, which has on its end a wheel 86 able to work in conjunction with control flaps or rails in the coupling and uncoupling areas in the stations. It can be seen that a force exerted downwards on the wheel 86 tends to pivot the crank 76 counter-clockwise in FIG. 1 and to move the piston rod 52 and the piston 50 towards the right in FIG. 1, in opposition to the springs 62. The link-rods 88, 90 are respectively hinged on the one hand on spindles 44, 48 and on the other hand with play on the spindles 92, 94, fixed to cam 64.

When the piston 50 slides to the right in FIG. 1, the link-rods 88, 90 exert on the jaws 38, 40 a moment in the direction of the opening of these jaws. The play at the level of the articulations on the spindles 92, 94 is sufficient to separate, during this maneuver, the cam 64 from the bearings 45, 49 which do not oppose this movement. At the limit of the opening of the jaws 38, 40, the bearings 45, 49 thrust against the boss 70, which limits the opening movement. Inversely, during a movement clamping the jaws 38, 40, engendered by the sliding towards the left of the piston 50, the link-rods 88, 90 are inactive, the clamping force being transmitted by the cam 64 bearing on the bearings 45, 49.

Figure 3:
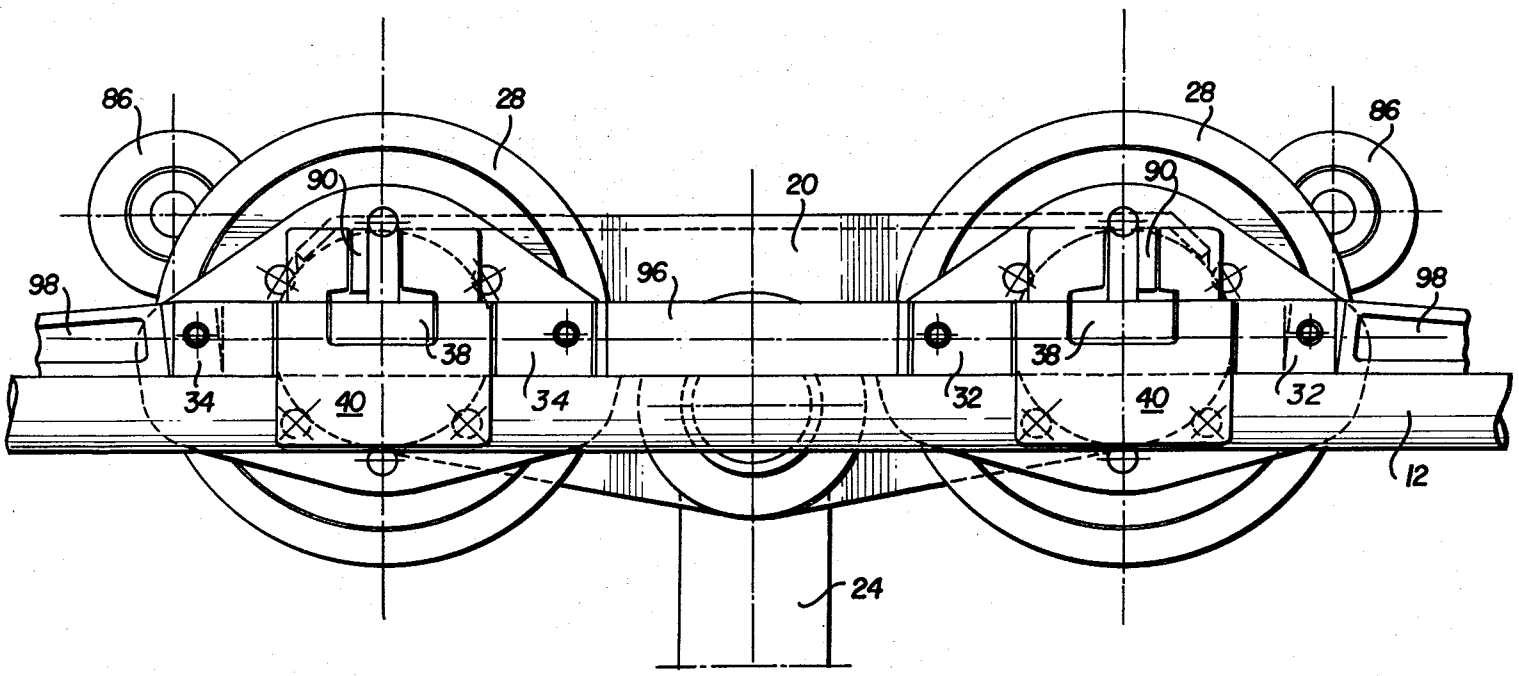
FIG. 3 is a view in plan of the carriage as per FIG. 2.

On referring more particularly to FIG. 3, it is seen that the carrier jaws 32, 34 are connected by a flexible part 96, and extend on each side in needles 98, in a manner well-known to experts, to facilitate the passing of the grips under the hold-down sheaves.

The grip according to the invention functions in the following manner:

During the erection of the installation, the grips of each carriage are adjusted by screwing or unscrewing the nut 60, so as to exert a predetermined clamping force on the cable 12. The height of the wheel 86 carried by the lever 80, is adjusted by screwing or unscrewing the screw 82, so that the wheel 82 is substantially horizontal, so as to limit lateral movement during the manoeuvres operating the grip.

In the normal position a force towards the left in FIG. 1 is exerted on the piston 50 by the springs 62, and the cam 64 is applied against the bearings 45, 49 while exerting a clamping force on the jaws 38, 40. The carriage 10 is fixed to or coupled on the cable 12. At the entrance to the station the opening of the grip or grips 14, 16, is operated by the running of the wheels 86 on a control rail which imparts to them a downward displacement. The pivoting of the levers 80, resulting from the downward movement of the wheels 86, causes a displacement to the right in FIG. 1 of the piston rod 52 and the compressing of the springs 62. In a first stage the cam 64 comes away from the bearings 45, 49, and after taking up the play at the levels of the articulations 92, 94 the cam 64 moves the link-rods 88, 90 to the right, which causes the symmetrical opening of the jaws 38, 40. This symmetrical opening permits a downwards disengagement of the cable 12 without any lateral deviation of the carriage 10. After the uncoupling the carriage 10 continues its travel in the station and the grips 14, 16 can be kept open by an extension of the control rail, or for preference closed again by permitting the return upwards of the wheel 86. While the wheel 86 is rising, the piston 50 moves towards the left in FIG. 1 and the cam 64 exerts, as the profiles 66, 68 come into contact with the bearings 45, 49, a clamping force on the jaws 38, 40 which close. The travel of the jaws 38, 40 when closing is limited by a stop (not shown) in the path of the piston 50.

For coupling the carriage 10 once more to the cable 12, it is obviously necessary to open the grip again by making the wheels 86 run on a control rail stretching along the coupling section.

It is easily seen that the controlling of the grip is particularly simplified, a single lever opening and closing the grip. The symmetrical opening of the jaws 38, 40 facilitates the freeing of the cable 12 from the grip. The forces operating the grips 14, 16 exerted downwards on the wheels 86 tend to apply the running wheels 28, 30 of carriage 10 to the carrier rails and prevent any swinging of this carriage. The jaws 38, 40 are thus perfectly positioned in relation to the cable 12 and any risk of a faulty hold on the cable is avoided.

In a simplified grip according to the invention, the opening as well as the closing movement may be transmitted to the jaws by the link-rods 88, 90.

What is claimed is:

1. A detachable grip for coupling a device supporting a load on to the overhead cable of a mono-cable transport installation comprising:

a grip body positioned, when the grip is coupled on to the cable, on one side of the cable;

a pair of jaws carried by the body of the grip and able in their approached position to clamp the cable to fix the body of the grip to the cable, the outer profile of the said pair of jaws being so designed as to be flush with the lower surface of the clamped cable and to form a limited projection on the top of the clamped cable to allow the passing of the jaws over the cable support sheaves and under the cable hold-down sheaves;

said jaws gripping the cable when closed and disengaged from the cable when open, said open jaws allowing the cable to move down and away from the jaws without any lateral movement of said jaws;

a control mechanism carried by the said grip body having a cam means to operate the closing of each jaw and link-rod means to operate the opening of the jaws;

a spindle fixed to the body of the grip and so devised that in the position in which the grip is coupled on to the cable the said spindle extends parallel to and above the cable in the vertical plane of the cable, the said jaws being both mounted symmetrically in rotation on said spindle;

an operating shank extending from each jaw towards said link-rod, with a curved end working in conjunction with the said control mechanism to impart to the said jaws a symmetrical rotation opening and/or closing the grip, the said operating shanks projecting laterally from the jaws on the grip body side while respecting the gauge for passing over cable support sheaves and hold-down sheaves, said operating shanks being set off in the longitudinal direction of said cable and when said jaws are closed said operating shanks as seen along the longitudinal direction of the cable, are superposed by said cable;

a piston comprising part of said control mechanism so mounted as to slide in the said grip body along an axis perpendicular to the jaw spindle, the curved ends of the operating shanks being arranged symmetrically with the said longitudinal axis and working in conjunction with the said piston;

said cam means being rigidly secured to said piston and working symmetrically in conjunction with the curved ends of the operating shanks in order to exert a cable clamping moment on the said jaws;

said link-rods connecting with play to said curved ends of the operating shanks and the piston in such manner as to pivot the jaws into the open position on the displacement of the piston into said grip body without interfering with the action of the cam transmitting the closing force.

2. A grip according to claim 1, having a closing spring housed in the said grip body and working in conjunction with the piston to exert by said cam means pressure on the jaws in the closed position and an operating lever to move the piston in opposition to the said spring and move by said link-rod means the said jaws positively into the opened position.

3. A grip according to claim 2, comprising link rods, the said curved ends of the operating shanks being connected by said link-rods to the said piston to transmit the movement of the piston to the said jaws.

4. A detachable grip for coupling a device supporting a load to the overhead cable of a mono-cable transport installation comprising:

a pair of movable jaws for gripping the cable, said jaws gripping the cable when closed and disengaged from the cable when open, said jaws when open permitting the cable to move down and away from the jaws without any lateral movement of said grip or load, said jaws when closed being substantially flush with the bottom surface of said cable and forming only a limited projection extending from the top surface of said cable, said limited projection being short enough for permitting the jaws to pass under the cable hold-down sheaves;

a spindle about which both jaws rortate, said spindle being parallel to and vertically above said cable when said jaws are closed;

a shank for each of said jaws, said shank extending laterally from said jaws on one side only of said cable, each of said shanks being curved at its end opposite the jaw forming end thereof;

a control mechanism having cam means for closing said jaws and link-rod means for opening said jaws, said control mechanism operably connected to an operating lever for symmetrically rotating said jaws to open and close said jaws;

a grip body on the same side of said cable as said shanks, said grip body carrying said jaws, shanks, and control mechanism, said operating lever extending generally parallel to said grip body; and the curved ends of said shanks being arranged symmetrically about the longitudinal axis of said grip body, and one curved end of each shank being pivotally connected to one end of each link-rod, the other end of each link-rod attached to a first end of a piston rod the other end of which is operably connected to said control lever, and said cam means comprising a cam roller located on each of said curved ends of said shanks and coaxial with the pivotal connection between shank and link-rod, each of said cam rollers being in camming engagement with a cam surface located at said first end of the piston rod, whereby both jaws are movable through said shanks, but said shanks permit the grip to pass under cable hold-down sheaves and over cable support sheaves.

* * * * *